United States Patent [19]

Skudrzyk

[11] Patent Number: 4,941,865

[45] Date of Patent: Jul. 17, 1990

[54] METHOD AND APPARATUS FOR FORMING METALLIZED PACKAGING MATERIAL

[75] Inventor: Joseph Skudrzyk, St. Louis County, Mo.

[73] Assignee: Packaging Concepts, Inc., St. Louis, Mo.

[21] Appl. No.: 261,222

[22] Filed: Oct. 24, 1988

[51] Int. Cl.[5] ..... B05D 3/12; B05D 1/88; B31B 1/17; B31F 7/02

[52] U.S. Cl. ..... 493/22; 493/11; 493/24; 493/327; 493/342; 493/369; 493/370; 493/467; 427/367; 427/368; 427/444; 51/165.79

[58] Field of Search ..... 493/10, 11, 22, 24, 493/327, 342, 373, 467, 369, 370; 427/360, 367, 368, 444; 118/672, 673; 51/165 R, 165.76, 165.79

[56] References Cited

U.S. PATENT DOCUMENTS 4,120,997 10/1978 Franks et al. ..... 427/367
4,608,037 8/1986 Fleming, III ..... 493/22
4,645,484 2/1987 Niske ..... 493/370

FOREIGN PATENT DOCUMENTS 1043785 11/1958 Fed. Rep. of Germany ..... 493/326

*Primary Examiner*—William Terrell
*Attorney, Agent, or Firm*—Paul M. Denk

[57] ABSTRACT

A continuous method of forming a repetitive pattern on a metallized film substrate is disclosed as including the steps of continuously feeding a web of metallized film substrate at a predetermined web speed, selective dry removal of predetermined metallized areas from the metallized film substrate during continuous movement thereof, and collecting metallized dust and flakes removed from the metallized film substrate during the aforementioned dry removal of predetermined metallized areas from the metallized film substrate. Unlike existing wet systems which remove metallized areas from a metallized film substrate, the present invention employs selective dry removal, along with the collection of dust, in a continuous in-line system. Following the selective removal of metallized areas from the metallized film substrate, metallized dust is collected in a closed dust removal system providing removal, transport and collection of the metallized dust in a storage unit.

7 Claims, 1 Drawing Sheet

METHOD AND APPARATUS FOR FORMING METALLIZED PACKAGING MATERIAL

BACKGROUND OF THE INVENTION

This invention relates to vacuum metallized paper or plastic films which have a wide range of uses in packaging and other industries. The existing technology for creating the desired patterns on metallized films is limited in that the desired pattern cannot be directly printed on the film in the vacuum metallizing process. Instead, the current technology requires the printing of a pattern of etchant-resistant material on a continuously moving web of metallized film substrate; applying an etchant over the etchant-resistant material, (usually by applying a 5% to 10% by weight of a NaOH solution); allowing the etchant solution to remain in contact with the metallized film substrate as it is continuously moved to permit the etchant solution to dissolve predetermined metallized areas of the metallized film substrate not having a pattern of etchant-resistant material applied thereto; washing the etchant solution from the metallized film substrate to leave the pattern of etchant-resistant material on desired predetermined areas of the web; and thereafter drying the resulting washed web of metallized film substrate, to provide the desired pattern.

Examples of this current technology, as described above, are shown in U.S. Pat. Nos. 4,398,994; 4,517,045; and 4,552,614. Other patents relating to multi-layering of metal patterns upon film substrates include the following U.S. Pat. Nos.: 4,242,378; 4,532,002; 4,448,636; 3,935,334; 3,985,597; 3,647,508; 2,748,031; and 2,139,640.

Because of the various steps and procedures involved in the above described process, it will be apparent that it is a relatively slow, complicated and expensive process. Quite obviously, there are many inherent limitations and restrictions in this current process involving metallized film which are attributable primarily to the wet system that is employed to remove metallized areas from the metallized film substrate.

SUMMARY OF THE INVENTION

Among the several objects and advantages of the present invention include:

The provision of a new and improved method for continuously forming a repetitive pattern on a metallized film substrate;

The provision of the aforementioned method which utilizes a dry removal system for eliminating predetermined metallized areas from a metallized film substrate;

The provision of the aforementioned continuous method which permits the dry removal of predetermined metallized areas from the metallized film substrate, without using a pre-printed or post-printed step, and without the use of chemicals, coatings or any type of wet chemical processing system for removing unwanted metal from the metallized film substrate;

The provision of the aforementioned continuous method in which the production of patterned metallized film is not limited by the inherent restrictions of the metallizing process, including the inherent limitations of standard film metallization;

The provision of the aforementioned continuous method which provides removal of predetermined metallized areas from a metallized film substrate in-line with other packaging, forming or processing equipment; and The provision of the aforementioned continuous method in which a faster, more economical and practical process of removing predetermined metallized areas from metallized film substrates in desired predetermined areas, in a pre-set registered distance, or in which metal can be removed entirely from the metallized film substrate.

Briefly stated, the continuous method of forming a repetitive pattern on a metallized film substrate according to the present invention includes the steps of: continuously feeding a web of metallized film substrate at a predetermined web speed; selectively dry removal of predetermined metallized areas from the metallized film substrate during continuous movement thereof; and collecting metallized dust or flakes removed from the metallized film substrate during the aforementioned dry removal of predetermined metallized areas from the metallized film substrate. Selective dry removal of predetermined metallized areas is preferably achieved through the use of a reversely rotating surface which mechanically engages and reworks predetermined metallized areas of the metallized film substrate for dry removal thereof. Continuously sensing a registered distance on the metallized film substrate and selectively removing predetermined metallized areas, which are separated from one another by the aforementioned register distance, may also be employed in the continuous method. Collection of metallized dust may be performed though the use of a closed dust removal system which includes removal, transport and collection of the metallized dust in a storage unit. All of the aforementioned operations may be performed as an in-line process, together with other operations on the metallized film substrate, in processing or packaging equipment.

Other objects and advantages of the present invention will become more apparent from the ensuing description.

DESCRIPTION OF THE PREFERRED EMBODIMENTS

Figure 1:
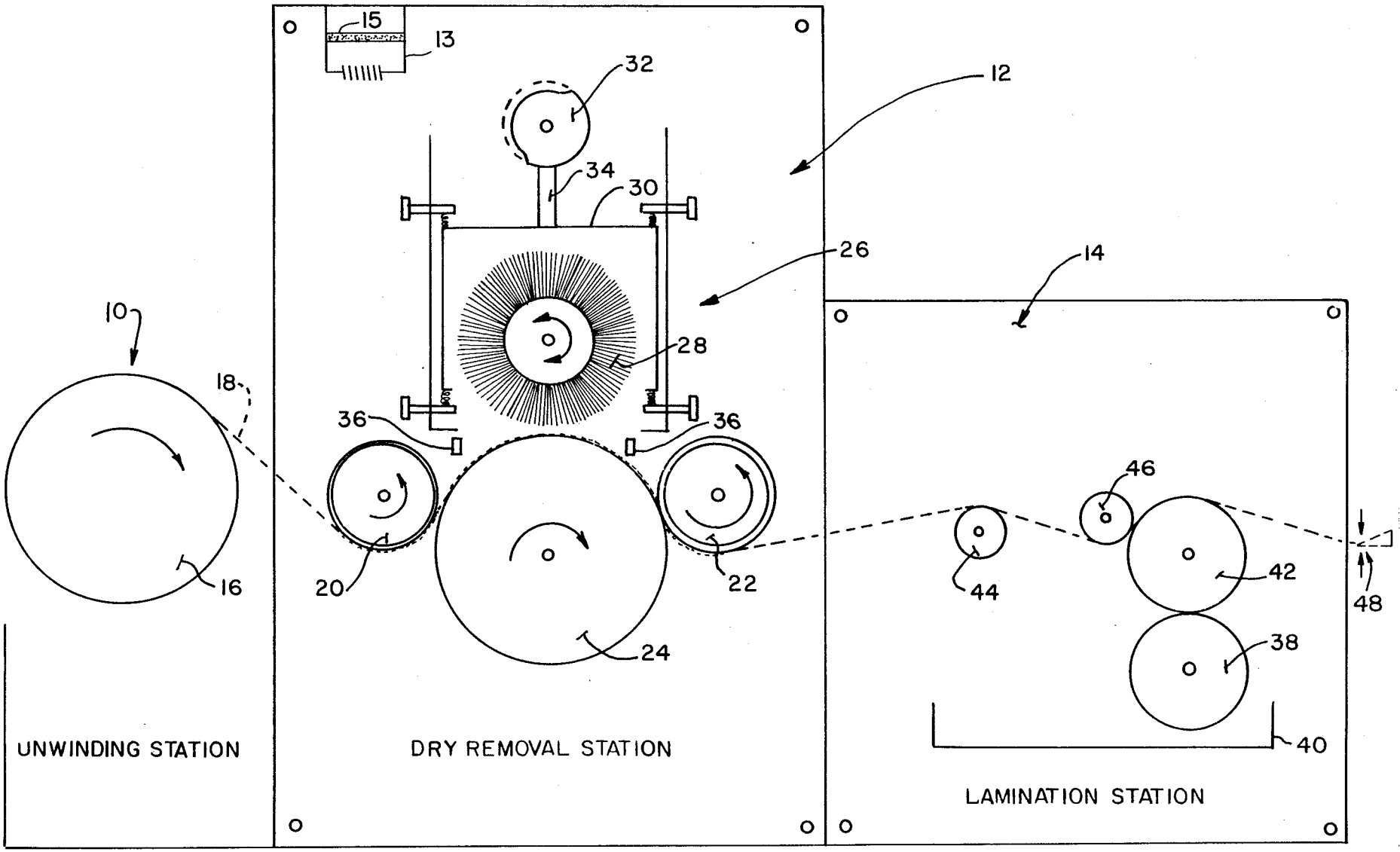
FIG. 1 is a side elevational diagrammatic view representing the continuous method or process of forming a repetitive pattern on a metallized film substrate which employs selective dry removal of predetermined metallized areas from a metallized film substrate and collection of metallized dust particles removed from the metallized film substrate, in accordance with the teachings of the present invention.

In accordance with the invention as described below, the continuous method of forming a repetitive pattern on a metallized film substrate is especially employed where polymer films such as polyester (PET) are demetallized, either totally or in a desired registered pattern, using a completely dry removal system. While wet systems have been the principal method of removing predetermined metallized areas from a metallized film substrate, requiring the printing or coating of a chemical material before or after the metallization process to establish the desired pattern, the dry removal system of the present invention eliminates the inherent limitations of the wet system, and thus represents a cost and speed breakthrough over the existing wet system technology. In addition, the dry removal of metallized film areas from a metallized film substrate allows the system to be used in-line with other package or processing equipment, whereas existing wet system technology is required to be off-line, which adds cost, increased processing time and complicates the control of pattern registration that is required in forming a repetitive pattern on a metallized film substrate.

Reference is now made to FIG. 1 of the drawing which illustrates the continuous method of forming a repetitive pattern on a metallized film substrate, according to the teachings of the present invention. Specifically, the in-line processing or packaging system illustrated in FIG. 1 shows a roll and winding station 10, a dry removal station 12 at which metallized film areas are removed from a metallized film substrate moving therethrough, and a lamination station 14 enabling other films or paper to be subsequently attached to the metallized film substrate, as may be desired. For reasons which will subsequently appear, the continuous method of the present invention enables a repetitive pattern to be formed on a metallized film substrate in an in-line packaging or processing system which includes a lamination station 14 or other suitable down stream station in the packaging or processing system, as may be desired.

At the unwinding station 10, the roll 16 comprises a convolutely wound metallized film substrate including at least two layers such as a polyester film base and a vacuum metallized film or layer coating applied thereto, as is well known. The convolutely wound roll 16 of metallized film substrate is shown as being rotated in a clockwise direction to allow the metallized film substrate identified at 18 to issue from the roll 16 as shown by the dotted line representation in the drawing. At the dry removal station 12, a pair of rubber-covered idler rollers 20, 22 are positioned at opposite sides of a larger rotating drum 24 to trap the moving web of metallized film substrate 18 across the upper moving surface of the larger rotating drum 24. Each of the smaller rubber-covered idler rolls 20, 22 are shown as being driven in a counter clockwise direction whereas the larger drum 24 is shown as being driven in a clockwise direction, to facilitate continuous engagement and movement of the web of the metallized film substrate 18 through the dry removal station 12. All the rollers are synchronized in their movement.

The selective dry removal system 26, for the selective dry removal of predetermined metallized areas from the continuously moving metallized film substrate 18, employs a counter clockwise or reversely rotating brush 28 which is moved into and out of selective engagement with the moving metallized film substrate 18 as it moves across the upper surface of the rotating drum 24. The rotating brush 28 is preferably mounted in a resilient box frame 30 to allow for a limited amount of play or adjustment of the brush 28 relative to the rotating drum 24, as will be appreciated. The rotating brush 28 and/or the resiliently mounted box frame 30 may be activated by a rotating cam 32 which engages an arm or shaft 34 associated with the brush 28 and/or resilient box frame 30 moving the brush 28 up and down relative to the moving metallized film substrate 18, as desired.

The dry removal station 12 is designed so that the metallized film substrate moves over the drum 24 at a production speed, corresponding with the unwinding of the metallized film substrate at the unwinding station 10. At the upper surface of the drum 24, the brush 28, preferably having nylon, metal or other suitably constructed bristles, is arranged to contact the moving metallized film substrate 18 at predetermined positions, such that reverse rotation or turning of the brush 28 relative to the moving metallized film substrate 18 physically removes metal from the substrate by mechanical engagement and reworking of the metallized film substrate 18.

The brush 28 is raised and lowered by the cam 32 which, in turn, is controlled by a series of sensors 36 which read the registered distance between the repetitive pattern to be formed in the metallized film substrate 18 and control the up or down positioning of the rotating brush 28 relative to the moving metallized film substrate 18. The registration of repetitive patterns to be formed in the metallized film substrate 18 is a combination of the control of the up and down movement of the brush 28 relative to the moving metallized film substrate 18, and the separate control of the speed of the drum 24 which moves the metallized film substrate 18 through the dry removal station 12. Both the rotating brush 28 and the drum 24 are set and controlled by a series of sensors 36 which are electrically connected to control the speed of the drum 24 and the operation of the cam 32, which produces the up and down movement of the brush 28, to accomplish the exact registration required.

The dry removal system 26 is incorporated within a closed dust removal system at the dry removal station 12. As is well known, metal dust has certain health and safety concerns. Exposure to metal dust, such as by inhaling, contamination, or other exposure to body parts may cause severe health problems. Further, it is well known that certain metal particles, such as aluminum, may even cause fire and explosion, if certain safety restrictions are not met. In addition, metallized particles may have other uses, such as an additive to paint, and therefore, are desirable for collection.

As will be appreciated, the dry removal of predetermined metallized areas from the metallized film substrate 18 generates considerable powdered dust or dust particles, and to eliminate health and safety problems as discussed above, a suitable enclosed dust removal system is contemplated in order to remove the metal dust and transport it from the dry removal station 12 to a storage unit where it can be collected. The potential for health and safety problems, as discussed above, is thereby overcome and eliminated by the closed dust removal system of the present invention. A low vacuum absorbing means 13, incorporating a filter 15, may be operatively associated with the station 12, and which may be located within its housing, and is provided to attract the metal dust particles, and collect them upon said filter.

Downstream from the dry removal station 12 is a lamination station 14 which is part of the in-line packaging or processing system that may be utilized with the dry removal process of the present invention. Specifically, a gluing cylinder 38 may convey glue from a trough 40 to the laminating cylinder 42 over which the metallized film substrate 18, having the predetermined patterns formed therein, is entrained. Suitable idler rollers 44, 46 may be used to appropriately and suitably position the moving metallized film substrate 18 over the laminating cylinder 42, for laminating other plastic or paper layers/substrates to the metallized substrate 18, as may be desired. Of course, other suitable stations, such as former for package forming, as at 48, may be employed in the processing or packaging in-line system as shown in the drawing, as may be desired.

From the foregoing, it will be appreciated that the new and improved method of the present invention removes predetermined metallized areas from moving metallized film substrates, without the pre or post printing of special chemicals of coatings that are necessary in wet systems. In addition, the washing of chemicals from the metallized film substrate and subsequent drying are totally eliminated by the dry removal process of the present invention, thus eliminating costly, time consuming and complicated processing steps. By employing physical rather that chemical removal of predetermined metallized areas from a metallized film substrate, the present invention also provides register with areas of removal in a simplified procedure. This registration is further enhanced by the in-line processing made possible in the packaging or processing line through employment of the dry removal process of the present invention.

In view of the above, it will be seen that the several objects of the invention are achieved and other advantageous results are obtained.

As various changes could be made in the above method without departing from the scope of the invention, it is intended that all matter contained in the above description or shown in the accompanying drawing shall be interpreted as illustrative and not in a limiting sense.

Having thus described the invention, what is claimed and desired to be secured by Letters Patent is:

1. A continuous method of forming a repetitive pattern on a metallized film substrate comprising the steps of:

continuously feeding a web of the metallized film substrate at a predetermined web speed;

selectively removing predetermined metallized areas from said metallized film substrate during continuous movement thereof;

said removing performed through the dry mechanical engagement and reworking of the metallized film substrate for removing said predetermined metallized areas from said web of metallized film substrate;

said mechanical engagement and reworking of the metallized film substrate performed with a rotating element having a surface which engages the surface of the continuously moving metallized film substrate; and said removing including repetitively sensing a registered distance on the metal film substrate and selectively actuating said rotating element to remove predetermined metallized areas separated from one another by said aforementioned registered distance.

2. The method as defined in claim 1 wherein the sensing and actuating steps include operating a combined cam and sensing system for sensing the predetermined registered distance in said continuously moving metal film substrate and cam actuating said rotating element for said aforementioned dry removal of predetermined metallized areas from said metallized film substrate.

3. The method as defined in claim 2 wherein the collecting of metallized dust during the selective dry removal of predetermined metallized areas from the metallized film substrate includes removing, transporting, and collecting the metallized dust in a storage unit.

4. The method as defined in claim 3 wherein the removal of predetermined metallized areas is performed in-line with forming a package from the web.

5. The method as defined in claim 1 wherein said mechanical engaging and reworking of said metallized film substrate includes operating a rotating brush with a circumferential array of bristles for engaging the continuously moving film substrate.

6. Apparatus for forming a repetitive pattern on a metallized film substrate, comprising:

web feeding means for continuously feeding a web of the metallized film substrate at a predetermined web speed;

metal removal means for selective dry removal of predetermined metallized areas from said metallized film substrate during continuous movement thereof;

said metal removing means comprises a rotating brush for engaging said metallized film substrate to remove said predetermined metallized areas therefrom;

dust collecting means for collecting metallized dust removed from said metallized film substrate during said aforementioned dry removal of predetermined metallized areas from said metallized film substrate; and cam means, and a sensing means, said cam means being responsive to said sensing means, and said sensing means provided for sensing a predetermined registered distance in said continuously moving metal film substrate, and responsively activating said cam means to move said rotating brush into position for removing said predetermined metallized areas from said metallized film substrate.

7. The apparatus of claim 6 and including a vacuum producing means associated with the dust collecting means, and a filter operatively associated with the vacuum producing means to collect the dust during removal.

* * * * *